US008322816B1

(12) United States Patent
Simmons

(10) Patent No.: US 8,322,816 B1
(45) Date of Patent: Dec. 4, 2012

(54) CAP DESIGN FOR AN INKJET PRINT HEAD WITH HAND-HELD IMAGING ELEMENT ARRANGEMENT WITH INTEGRATED CLEANING MECHANISM

(75) Inventor: Asher Simmons, Corvallis, OR (US)

(73) Assignee: Marvell International Ltd. (BM)

( * ) Notice: Subject to any disclaimer, the term of this patent is extended or adjusted under 35 U.S.C. 154(b) by 0 days.

(21) Appl. No.: 13/371,191

(22) Filed: Feb. 10, 2012

Related U.S. Application Data

(63) Continuation of application No. 12/039,491, filed on Feb. 28, 2008, now Pat. No. 8,128,192.

(51) Int. Cl.
*B41J 2/165* (2006.01)
*B41J 2/15* (2006.01)
*B41J 2/145* (2006.01)
*B41J 3/36* (2006.01)

(52) U.S. Cl. ..... 347/29; 347/24; 347/31; 347/32; 347/33; 347/40; 347/47; 347/109

(58) Field of Classification Search ..... 347/29, 347/32, 33, 40, 47, 109
See application file for complete search history.

(56) References Cited

U.S. PATENT DOCUMENTS

| | | | |
|---|---|---|---|
| 3,469,422 | A | 9/1969 | Minton |
| 4,387,579 | A | 6/1983 | Branke et al. |
| 5,825,995 | A | 10/1998 | Wiklof et al. |
| 6,030,582 | A | 2/2000 | Levy |
| 6,217,017 | B1 | 4/2001 | Yamazaki |
| 6,312,124 | B1 | 11/2001 | Desormeaux |
| 6,332,677 | B1 | 12/2001 | Steinfield et al. |
| 6,357,939 | B1 | 3/2002 | Baron |
| 6,390,249 | B2 | 5/2002 | Tachibana |
| 6,580,244 | B2 | 6/2003 | Tanaka et al. |
| 6,682,190 | B2 | 1/2004 | Rasmussen et al. |
| 6,789,869 | B2 | 9/2004 | Takeishi |
| 6,851,878 | B2 | 2/2005 | Hemmerlin |
| 6,896,349 | B2 | 5/2005 | Valero et al. |
| 6,933,889 | B1 | 8/2005 | Wolf et al. |
| 6,942,335 | B2 | 9/2005 | Trent |
| 6,951,778 | B2 | 10/2005 | Akhavain et al. |
| 6,952,284 | B2 | 10/2005 | Andrews et al. |
| 8,079,765 | B1 | 12/2011 | Bledsoe |
| 8,083,422 | B1 | 12/2011 | Simmons et al. |
| 8,096,713 | B1 | 1/2012 | Bledsoe |
| 2003/0117456 | A1 | 6/2003 | Silverbrook et al. |
| 2004/0135842 | A1 | 7/2004 | Saksa |
| 2004/0252051 | A1 | 12/2004 | Johnson |

(Continued)

FOREIGN PATENT DOCUMENTS

EP 1 543 981 A1 7/2006

(Continued)

OTHER PUBLICATIONS

Search Report for GB Application No. 0610837.7, dated Oct. 31, 2006, 2 pages.
HP Ink Jet Printer Cartridge Anatomy, http://wandel.ca.hp45_anatomy/index.html, printed Apr. 19, 2007, pp. 1-8.
International Search Report mailed Jul. 28, 2008, for International Application No. PCT/US2008/55636.
U.S. Appl. No. 12/036,862, entitled, "Print Head Configuration for Hand-Held Printing," filed Feb. 25, 2008, 32 pages.

(Continued)

*Primary Examiner* — Ryan Lepisto

(57) ABSTRACT

The hand-held printer includes a print module configured for multidirectional printing, a print head in communication with the print module. The print head includes a plurality of nozzle arrays and wherein the nozzles in each of the plurality of nozzle are disposed substantially equidistant from a reference point. The hand-held printer further includes a circular cap configured to rotatably cooperate with the print head, wherein the circular cap cooperates with the print head to define a seal when the circular cap is disposed in a closed position.

20 Claims, 9 Drawing Sheets

U.S. PATENT DOCUMENTS

| | | | |
|---|---|---|---|
| 2006/0279784 | A1 | 12/2006 | Carlson et al. |
| 2007/0009277 | A1 | 1/2007 | Shoen |
| 2007/0080494 | A1 | 4/2007 | Marshall et al. |
| 2008/0211864 | A1 | 9/2008 | Mealy et al. |
| 2008/0213018 | A1 | 9/2008 | Mealy et al. |
| 2008/0215286 | A1 | 9/2008 | Mealy et al. |

FOREIGN PATENT DOCUMENTS

| | | | |
|---|---|---|---|
| WO | WO 03/055689 | A1 | 7/2003 |
| WO | WO 2004/056577 | A1 | 7/2004 |
| WO | WO 2005/070684 | A1 | 8/2005 |

OTHER PUBLICATIONS

U.S. Appl. No. 12/041,466 entitled, "Ink Supply for a Hand-Held Ink Jet Printer," filed Mar. 3, 2008, 38 pages.

U.S. Appl. No. 12/074,123, entitled, "Managing Project Information with a Hand-Propelled Device," filed Feb. 28, 2008, 50 pages.

U.S. Appl. No. 12/141,717, entitled Hand-Held Printing Device and Method for Tuning Ink Jet Color for Printing on Colored Paper, filed Jun. 18, 2008, 38 pages.

Written Opinion of the International Searching Authority mailed on Jul. 28, 2008, for International Application No. PCT/US2008/55636.

CAP DESIGN FOR AN INKJET PRINT HEAD WITH HAND-HELD IMAGING ELEMENT ARRANGEMENT WITH INTEGRATED CLEANING MECHANISM

This application is a continuation of U.S. patent application Ser. No. 12/039,491, filed Feb. 28, 2008, which is hereby incorporated by reference in its entirety.

CROSS REFERENCE TO RELATED APPLICATIONS

This patent document claims the priority benefit under 35 U.S.C. §119(e) of U.S. provisional application 60/892,089, filed on Feb. 28, 2007, the content of which is incorporated herein by reference for all purposes

BACKGROUND

Known printers often utilize a mechanically driven carriage to linearly propel, position and transport a print head to a desired position adjacent to a print medium. The print medium, in turn, is mechanically driven and positioned underneath and/or adjacent to the print head. During a print operation, the print head and the print medium are positioned relative to each other as an image is laid down. The known printers also include a cleaning mechanism comprising a set of mechanical gears that translate one or more wipers across the print head before, during, and after printing. A service station may also be provided to cap the pens when there are no print jobs to keep the ink from leaking or drying out.

Other known printers are designed and configured to be portable. For example, portable printers often include miniaturized components to reduce the overall weight and size of the device. Regardless of the size of these portable printers, the configuration and motion of the print head, the print medium, and the service station operate in the same manner as the known printers discussed above. Thus, the print head, print medium, and service station drive mechanisms limit the size reduction of the printer as well as the material that may be used as the print medium.

SUMMARY

The present disclosure generally relates to hand-held printers and more particularly to hand propelled printers including individual inkjets and/or an inkjet array optimized for hand-held printing. It would be desirable to provide a printer having increased portability and/or mobility over the known printers and portable printers. It would further be desirable to provide a mobile printer that may reduce and/or eliminate the need for the print head, print medium, and service station drive mechanisms utilized within the known printers and portable printers. Moreover, it would be desirable to provide a device and method configured to maintain and service a print head optimized for use with a hand-propelled or driven printing device.

In one embodiment, a hand-held printer is disclosed. The hand-held printer includes a print module configured for multidirectional printing and a print head in communication with the print module. The print head comprises a plurality of nozzle arrays and the nozzles in each of the plurality of nozzle are disposed substantially equidistant from a reference point. The hand-held printer further includes a circular cap configured to rotatably cooperate with the print head, wherein the circular cap cooperates with the print head to define a seal when the circular cap is disposed in a closed position.

In another embodiment, a method of maintaining a print head is disclosed. The method includes aligning a cleaning cap to a nozzle array portion of the print head, rotatably engaging the nozzle array portion with a cleaning pad carried by the cleaning cap, sealing the cleaning pad against the nozzle array portion, and creating a vacuum between the sealed cleaning pad and the nozzle array portion.

In another embodiment, a hand-held printer is disclosed. The hand-held printer includes a plurality of concentric print arrays, and each of the plurality of concentric print arrays includes a plurality of print nozzles, a scanning array, where the scanning array is disposed at a center point and the center point is defined within the plurality of concentric print arrays such that each of the plurality of concentric print arrays is substantially equidistant to the scanning array, and a circular cap configured to rotatably cooperate with the plurality of concentric print arrays.

In another embodiment, a hand-held printer is disclosed. The hand-held printer includes means for multidirectional printing, means for printing in communication with the means for multidirectional printing where the means for printing is disposed substantially equidistant around a reference point means for closing, and the means for closing is configured to rotatably cooperate with the means for printing, and means for sealing carried within the means for closing.

Additional features and advantages of the disclosed hand-held printer are described in, and will be apparent from, the following Detailed Description and the figures.

DETAILED DESCRIPTION

The embodiments and concepts discussed herein provide for a mobile or hand propelled printer having a compact size and suitable for printing on a wide variety of print mediums. The exemplary mobile or hand propelled printer eliminates the carriage and paper handling mechanisms and may include scanning and position sensors.

Figure 1:
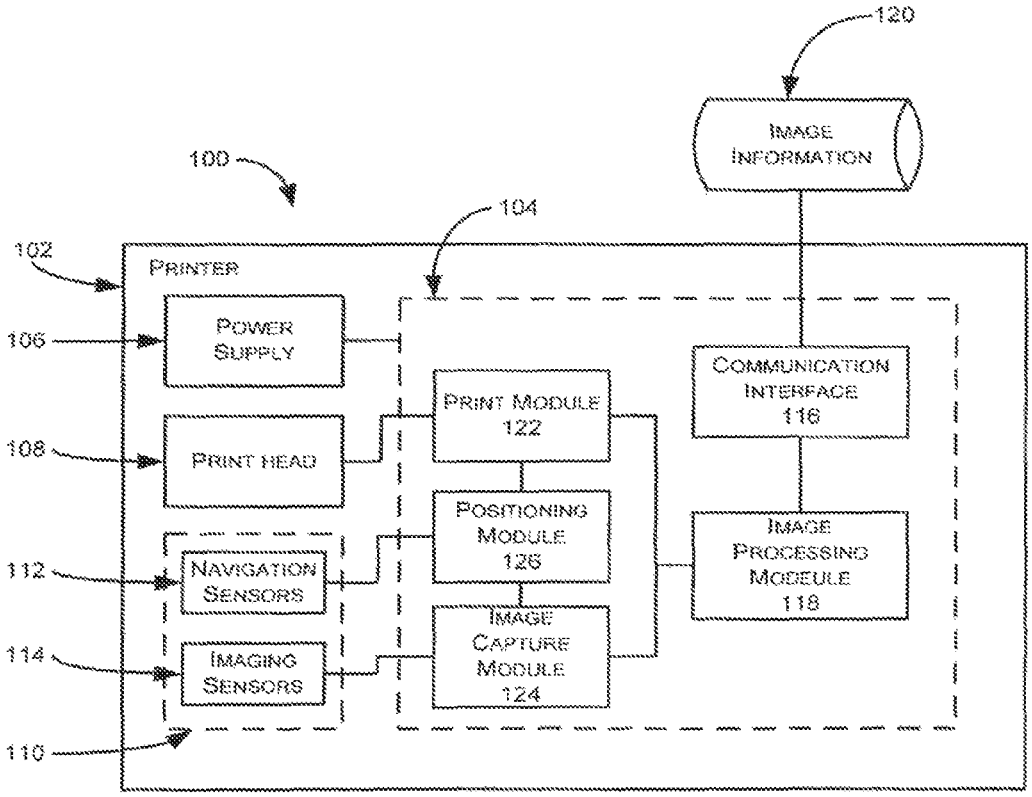
FIG. 1 is a logical schematic of a hand-held printer in accordance with the teachings disclosed herein.

FIG. 1 illustrates a schematic 100 depicting the physical and logical components of a mobile or hand propelled printer 102. As used herein, the terms printer, printing device, hand-held printer, mobile printer and hand propelled printer are intended to be synonymous and interchangeable. The printer 102 may include a controller 104 powered by a power supply 106 and in communication with a print head 108 and a sensor suite 110. The sensor suite 110, in this exemplary embodiment, may include one or more position or navigation sensors 112 and one or more optical imaging sensors 114. The controller 104 and the sensor suite 110 cooperate to facilitate precise and accurate positioning of the print head 108 throughout printing and/or scanning operations. Precise positioning allows the printer 102 to reliably produce or print images and scan or acquire images.

The controller 104 may include a communication interface or module 116 coupled to an image processing module 118 and an image information source 120. The image processing module 118 may, in turn, be communicatively coupled to a print module 122 and an image capture module 124. The print module 122 and image capture module 124 are, in this exemplary embodiment, communicatively coupled to a positioning module 126.

The image information source 120 may be any type of device capable of transmitting data related to an image, picture or file to be printed by the print head 108. The image information source 120 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If, for example, the image information source 120 is a removable storage device, e.g., a universal serial bus (USB) storage device, the communication interface 116 may include a port, e.g., a USB port, to engage and communicatively receive the storage device. In another embodiment, the communication interface 116 may include a wireless transceiver to allow for the wireless communication of image data between the image information source 120 and the controller 104. Alternatively, the communication interface 116 may facilitate creation of an infrared (IR) communication link, a radio-frequency (RE) communication link or any other known or contemplated communication system, method or medium.

The communication interface 116 may, in other alternate embodiments, be configured to communicate with the image information source 120 through one or more wired and/or wireless networks. The networks may include, but are not limited to, a personal area network (PAN), a local area network (LAN), a wireless local area network (WLAN), a wide area network (WAN), etc. The networks may be established in accordance with any number of standards and/or specifications such as, for example, IEEE 802.11x (where x indicates a, b, g and n, etc.), 802.16, 802.15.4, Bluetooth, Global System for Mobile Communications (GSM), code-division multiple access (CDMA), Ethernet, etc.

The image processing module 118 may receive the image data from the communication interface 116 and process the received image data to facilitate the printing process. Alternatively, the processing of the image data may be performed by the image information source 120 or other device or module and communicated to the communication interface 116. The processed image data may, in turn, be provided to the print module 122. The print module 122 can cache or store the processed image data or may communicate the data in real-time for printing by the print head 108.

The positioning module 126 may provide position information to the print module 122. The position information may be utilized to calculate the relative position of the print head 108 to a reference point defined or established on the print medium or within the image data being printed and/or scanned. The position information may be generated or calculated by the positioning module 126 based on signals, measurements or other information received from the one or more navigation sensors 112. The navigation sensors 112 may, for example, be an optoelectronic sensor, an electromechanical sensor or one or more inertial sensors configured to provide location and direction information to the printer 102 and the print head 108. The location and directional information may, in turn, be utilized by the positioning module 126 to determine the precise location of the printer 102 and print head 108 relative to the surface of the print medium upon which the image data is to be reproduced. Print medium, as discussed herein, may be any type of material or medium on which a printing substance, e.g., ink, powder, etc, may be deposited.

The position information provided by the navigation sensors 112 may be utilized by the print module 122, via the positioning module 126, to coordinate the location of the print head 108 to a position within the processed image data provided by the image processing module 118. The print module 122 may then direct and control the print head 108 to dispense and deposit ink on the print medium to represent the corresponding portion of the processed image data.

The print head 108 may be an inkjet print head having a plurality of nozzles or primitives (see FIGS. 2A and 2B for details) configured to dispense a printing substance, e.g., liquid ink droplets, on a print medium. The printing substance may be contained in reservoirs or cartridges. The reservoirs or cartridges may contain or store black ink, and/or multiple colors such as cyan ink, magenta ink, yellow ink, and black ink. Other embodiments may utilize other printing techniques, e.g., toner-based printers such as laser or light-emitting diode (LED) printers, solid ink printers, dye-sublimation printers, inkless printers, etc.

The image capture module 124 may receive image information from the one or more optical imaging sensors 114. The optical imaging sensors 114 may be charge coupled devices (CCDs) configured and arranged to capture a plurality of images representative of the surface of the print medium or other scannable medium. The plurality of images may be processed by the image capture module 124 and reassembled to generate a representation of the print medium or scannable medium. The image capture module 124 may receive positioning information from the positioning module 126 to facilitate the arrangement and reassembly of the plurality of captured images provided by the optical image sensors 114. In this manner, the printer 102 may be utilized to scan, process, store and duplicate images via the cooperation of the image capture module 124, the positioning module 126 and the print module 122.

The image capture module 124 may, in another embodiment, be utilized to calibrate the positioning module 126. For example, an image captured by the optical image sensors 114 may be compared to the processed image data provided by the image processing module 118 to correct or compensate for accumulated positioning errors and/or to reorient the positioning module 126. For example, if the printer 102 is removed from the print medium during a printing procedure, the positioning module 126 may lose track of the reference point associated with the printing procedure.

Figure 2A:
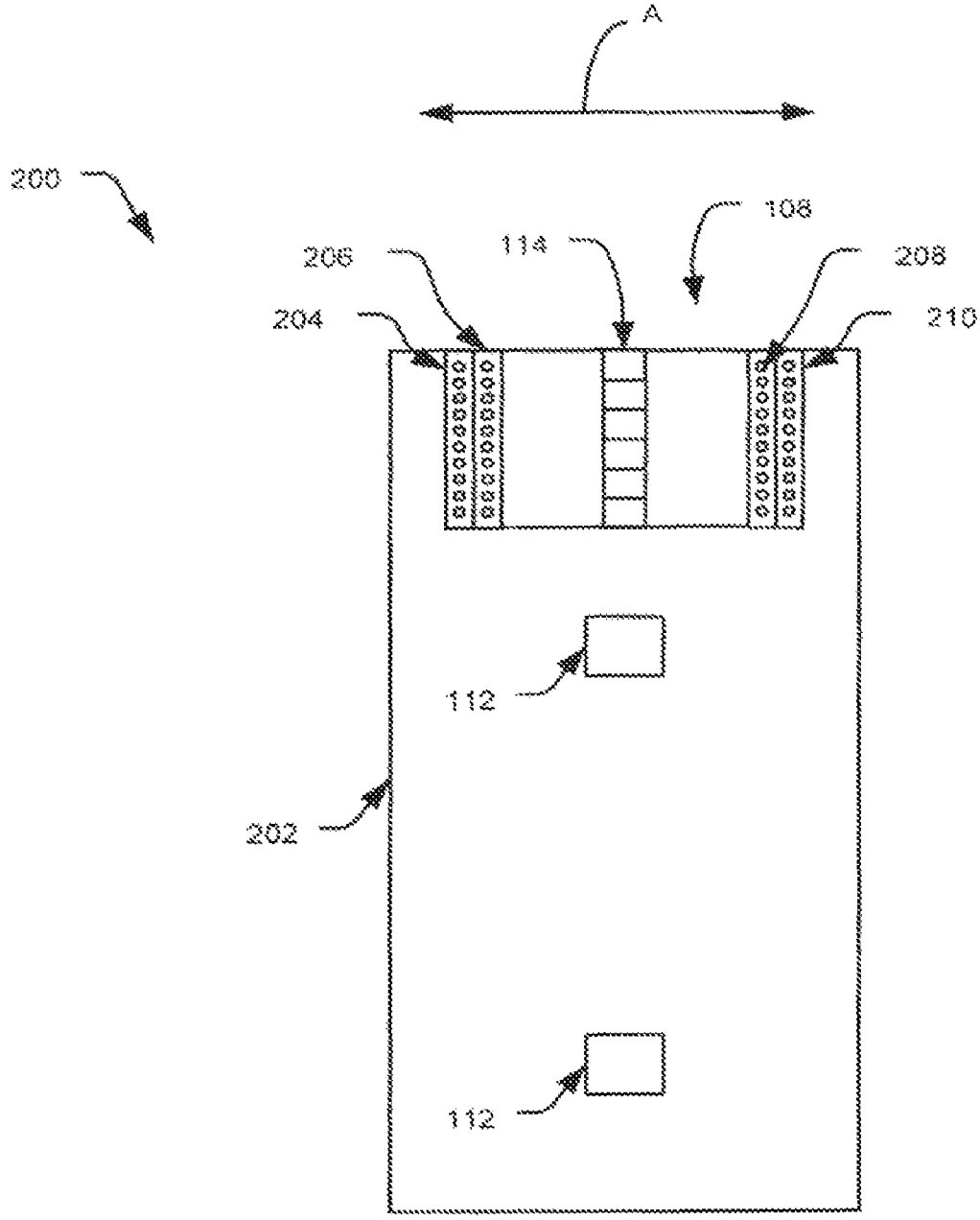
FIG. 2A is a bottom plan view of the hand-held printer discussed in conjunction with FIG. 1.

FIG. 2A illustrates a bottom plan view of a printing device 200 which may be constructed to include the teachings discussed in conjunction with the logical schematic 100 and the mobile or hand propelled printer 102. Thus, the components and elements of the printer 102 may be included in, or integral to, the printing device 200. For example, the printing device 200 includes a housing 202 that supports and carries the print head 108 and the sensor suite 110 including a pair of navigation sensors 112 and one or more optical image sensors 114.

The pair of navigation sensors 112 may be used by the positioning module 126 (see FIG. 1) to determine positioning information related to the optical imaging sensors 114 and/or the print head 108. The housing 202 supports the optical imaging sensors 114 and the print head 108 fixed relative to the pair of navigation sensors 112 such that the image and/or position information obtained by the navigation sensors 112 may be precisely correlated to the relative to the optical imaging sensors 114 and the print head 108.

The print head 108, in this exemplary embodiment, may be an inkjet print head having a number of nozzle arrays for different colored inks. For example, if the print head 108 is a color (CMYK) print head, it may include a nozzle array 204 for cyan-colored ink (C), a nozzle array 206 for magenta-colored ink (M), a nozzle array 208 for yellow-colored ink (Y), and nozzle array 210 for black-colored ink (K). The nozzle arrays 204 to 210 of the print head 108 may be arranged adjacent to optical imaging sensors 114. This configuration allows the optical imaging sensors 114 to capture information about the ink deposited on the print medium by the print head 108 as it is dispensed. This information may be used for error correction and verification of the processed image data throughout the dispensing and/or printing processes.

The nozzle arrays 204 to 210 in this exemplary embodiment are arranged according to color. For example, the arrangement and order of the colors stored within the nozzle arrays 204 to 210 may be based on predetermined deposition orders and/or amounts necessary to create new colors by depositing and thereby mixing the colors stored within the nozzle arrays 204 to 210. Utilization of different base or constituent colors, e.g., colors other than CMYK, may require a different nozzle order or arrangement to produce the desired colors, color combinations, etc.

Figure 2B:
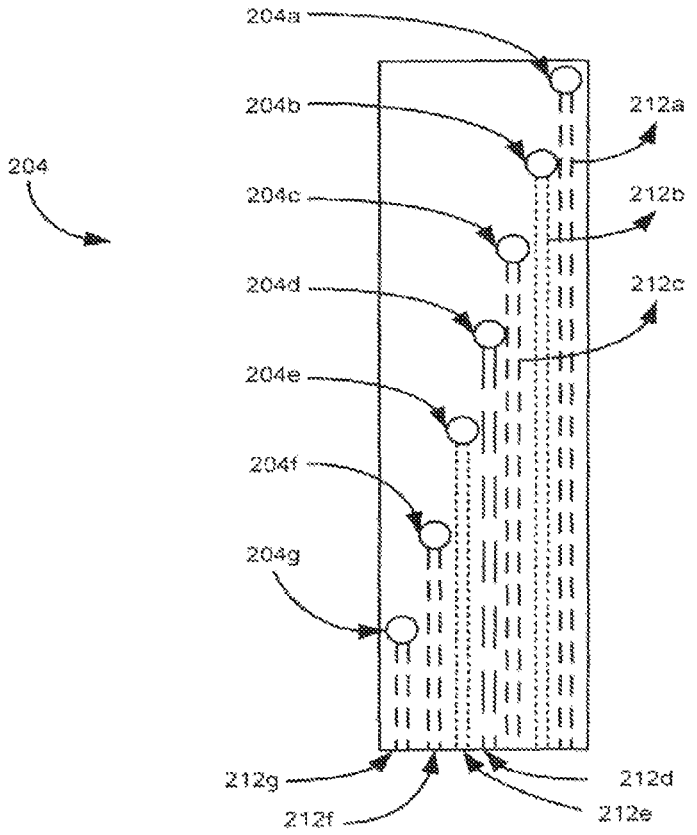
FIG. 2B is an enlarged plan view of a nozzle array shown in FIG. 2A.

FIG. 2B illustrates an enlarged plan view of the nozzle array 204. It will be understood that the nozzle array 204 is shown by way of example, and that the teaching and concepts discussed in connection with this exemplary nozzle array may be applied to other nozzle arrays and/or nozzle array configurations. The nozzle array 204 includes a plurality of individual nozzles identified by the reference numerals 204*a* to 204*g*. As illustrated in FIG. 2B, the nozzles 204*a* to 204*g* are staggered or offset along the length of the nozzle array 204. The stagger allows for the manufacture or formation of fluid passages 212*a* to 212*g*, which correspond to the nozzles 204*a* to 204*g*, respectively. The fluid passages 212*a* to 212*g* may be fluidly coupled to a reservoir (not shown) containing or storing the printing substance or ink to be dispensed through the nozzles 204*a* to 204*g*.

Figure 2C:
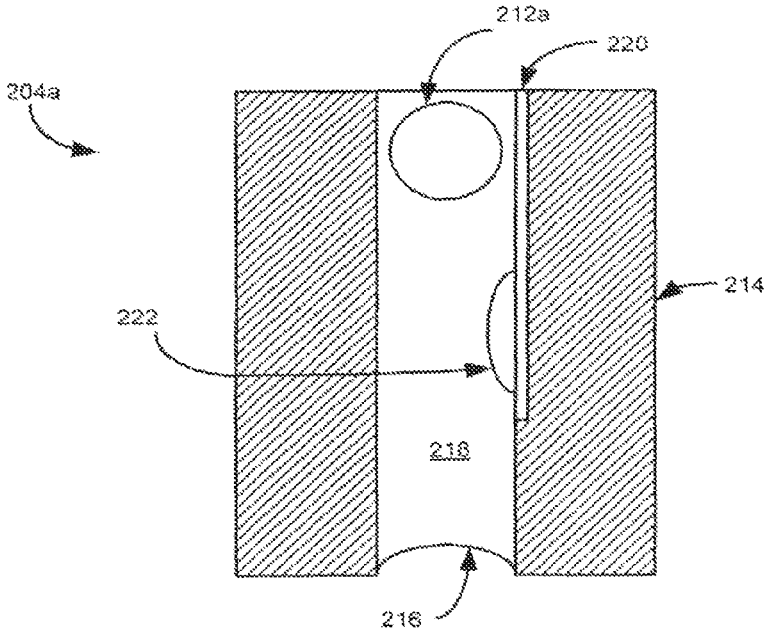
FIG. 2C is an enlarged cross-sectional view of a nozzle shown in FIGS. 2A and 2B.

FIG. 2C illustrates an enlarged cross-sectional view of the exemplary nozzle 204*a*. In particular, the nozzle 204*a* may be formed within a casing 214 such that the fluid passage 212*a* is fluidly coupled to a dispensing orifice 216. In operation, the printing substance may be provided to the nozzle 204*a* via the fluid passage 212*a* and a dispensing chamber 218. A dispensing chamber 218 may be provided for each of the nozzles 204*a* to 204*g* and individually identified as 218*a* to 218*g*, respectively. The printing substance or ink, once delivered to the dispensing chamber 218, may be retained via capillary action.

The nozzle 204*a* may further include a heating element 220 such as, for example, a resistor. In operation, the heating element 220 creates heat in response to an applied electric current. The heat, in turn, creates a bubble 222 by vaporizing the printing substance. As the bubble 222 expands, the printing substance within the dispensing chamber 218 may be forced through the dispensing orifice 216 and onto the surface of the print medium (not shown). When the bubble 222 collapses, ink may be ejected and a vacuum may be created. The resulting vacuum pulls or resupplies printing substance from the reservoir (not shown) into the dispensing chamber 218 via the fluid passage 212*a*. By activating and/or firing individual heating elements within each of the nozzles 204*a* to 204*g* which make up the printing array 204, the print head 108 and print module 122 may dispense printing substance on the print medium to create an image.

Figure 3:
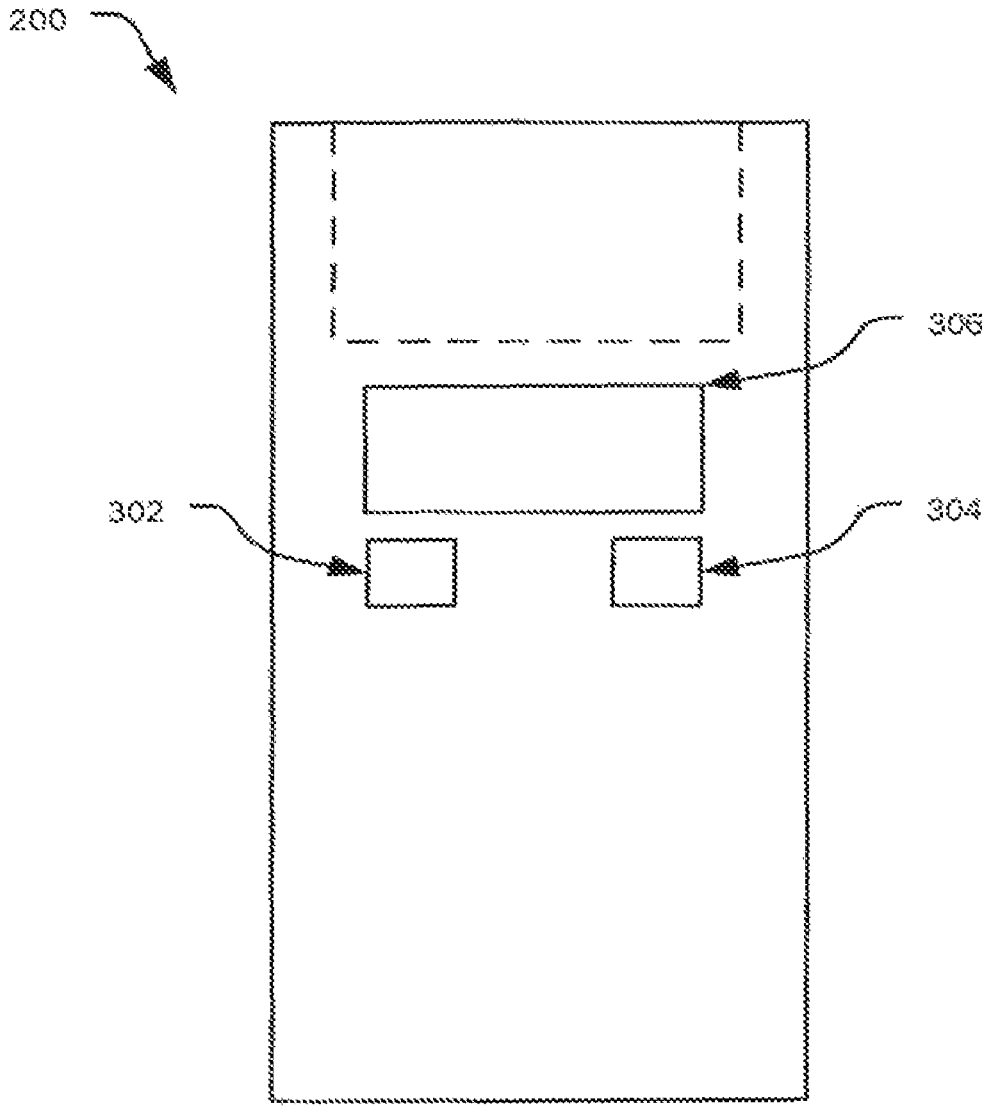
FIG. 3 is a top plan view of the hand-held printer shown in FIG. 2A.

FIG. 3 illustrates is a top plan view of the printing device 200 shown in FIG. 2A. The printing device 200 may include a variety of user controls, buttons, touch screens, etc., based on the functionality designed into or supported by the controller 104 shown in FIG. 1. For example, the printing device 200 includes a print control input 302, a scan control input 304 and a display 306 communicatively coupled to the controller 104. The print control input 302 may provide a signal to the controller 104 that can be utilized to initiate/resume a print operation. The scan control input 304 may provide a signal to the controller 104 that can be utilized to initiate/resume a scan operation.

The display 306, which may be a passive display, an interactive display, etc., may provide the user with a variety of information. The information may relate to the current operating status of the printing device 200 (e.g., printing, ready to print, scanning, ready to scan, receiving print image, transmitting print image, transmitting scan image, etc.), power of the battery, errors (e.g., scanning/positioning/printing error, etc.), or instructions (e.g., "position device over a printed portion of the image for reorientation," etc.). If the display 306 is an interactive display it may provide a control interface in addition to, or as an alternative from, the control inputs 302 and 304.

Figure 4:
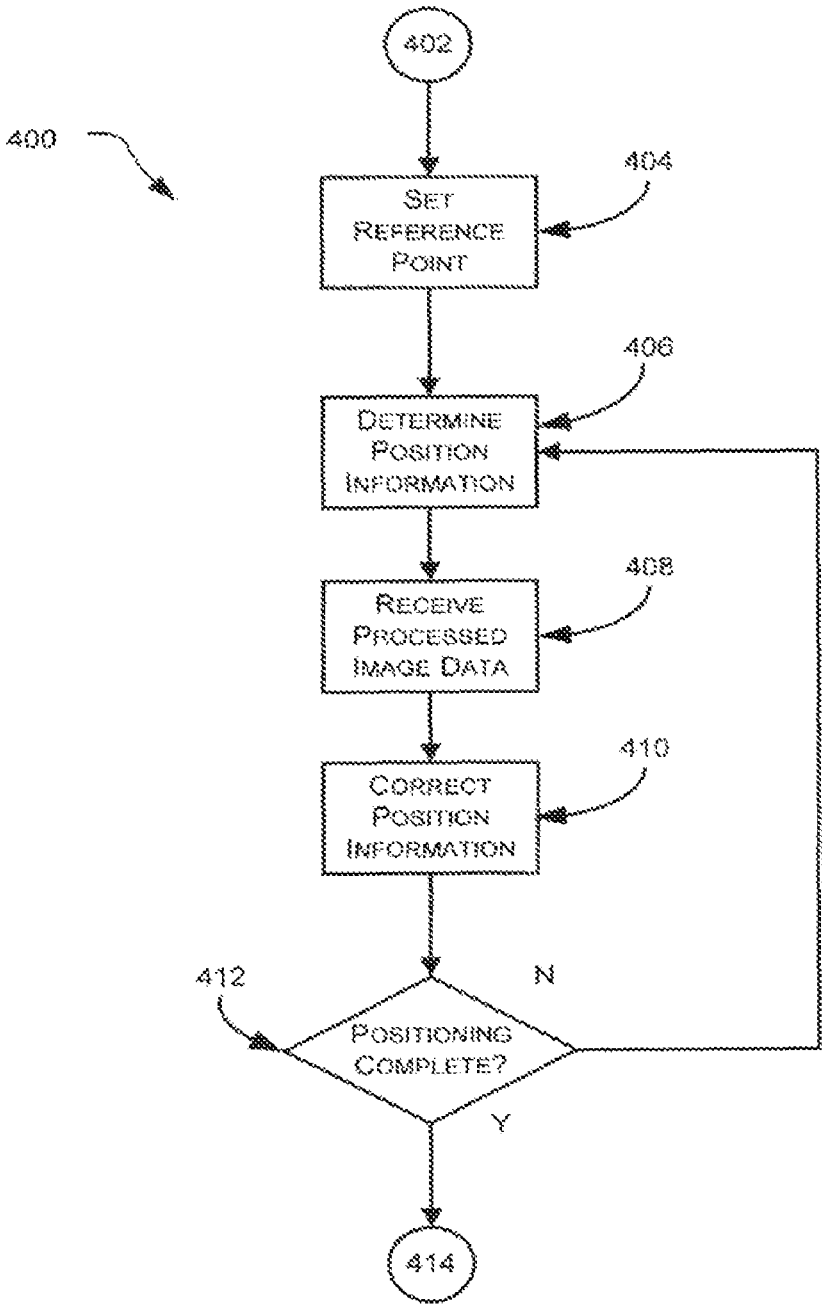
FIG. 4 is a flowchart describing an exemplary positioning operation that may be performed by the hand-held printer.

FIG. 4 depicts a flow diagram illustrating an exemplary positioning operation 400 that may be performed by the printing device 200 shown in FIG. 2. At block 402, the positioning operation 400 may begin with the initiation of a scanning or a printing operation. For example, the print control input 302 (see FIG. 3) may provide a signal to the controller 104 (see FIG. 1) to initiate a print operation, or the scan control input 304 (see FIG. 3) may provide a signal to the controller 104 to initiate a scan operation.

At block 404, a reference point on the printing medium may be established by the positioning module 126. For example, the user may be instructed via text or graphics provided by the display 306 to activate one of the inputs 302, 304 when the printing device 200 is positioned in a desired starting location. Alternatively, the user may preposition the printing device 200 in the desired starting location and orientation and the reference point may be established upon activation of the appropriate input 302, 304.

At block 406, the positioning module 126 may utilize information provided by the navigation sensors 112 to determine position information, e.g., translational and/or rotational changes relative to the reference point, for the printing device 200. The translational changes may be determined by tracking incremental changes of the positions of the navigation sensors along a two-dimensional coordinate system, e.g., $\Delta x$ and $\Delta y$. Rotational changes may be determined by tracking incremental changes in the angle of the printing device, e.g., $\Delta\Theta$, with respect to, e.g., the y-axis. These transitional and/or rotational changes may be determined by the positioning module comparing consecutive navigational images taken by the navigation sensors 112 to detect these movements.

At block 408, the positioning module 126 may further receive the processed image data from the image processing module 118. If all or part of an image has been previously deposited or printed at a given location, the optical image sensors 114 may be utilized to verify the accuracy of the calculated position location with respect to the received processed image data. For example, the optical image sensors 114 may sample the deposited image (or image to be scanned) and compare that sample to a corresponding position within the received processed image data. This verification process may further note and compensate for images in which the printing and/or deposition is incomplete.

At block 410, the positioning module 126 may correct for differences and deviations between the calculated position location and the received processed image data. For example, with enough information, e.g., sufficient material deposited in the location scanned by the optical image sensors 114, the positioning module 126 may offset and align the position information ensure that the two images match. If the positioning module 126 is unable to determine an appropriate offset based on the available information, the optical image sensors 114 may be utilized to gather more information, identify patterns, etc. The additional information and/or patterns may, in turn, be utilized by the positioning module 126 to determine the offset necessary to align the calculated position location and the received processed image data. Correction and compensation may be performed continually or periodically based on, for example, image complexity, available processing power, desired resolution, etc.

At block 412 the status of the positioning operation 400 and calculations may be evaluated. If the position information is determined to be accurate, then at block 414 the positioning operation 400 may be completed. If the position information is incomplete, inaccurate or otherwise unacceptable, then positioning operation 400 may return to block 406 and begin the process again.

Figure 5:
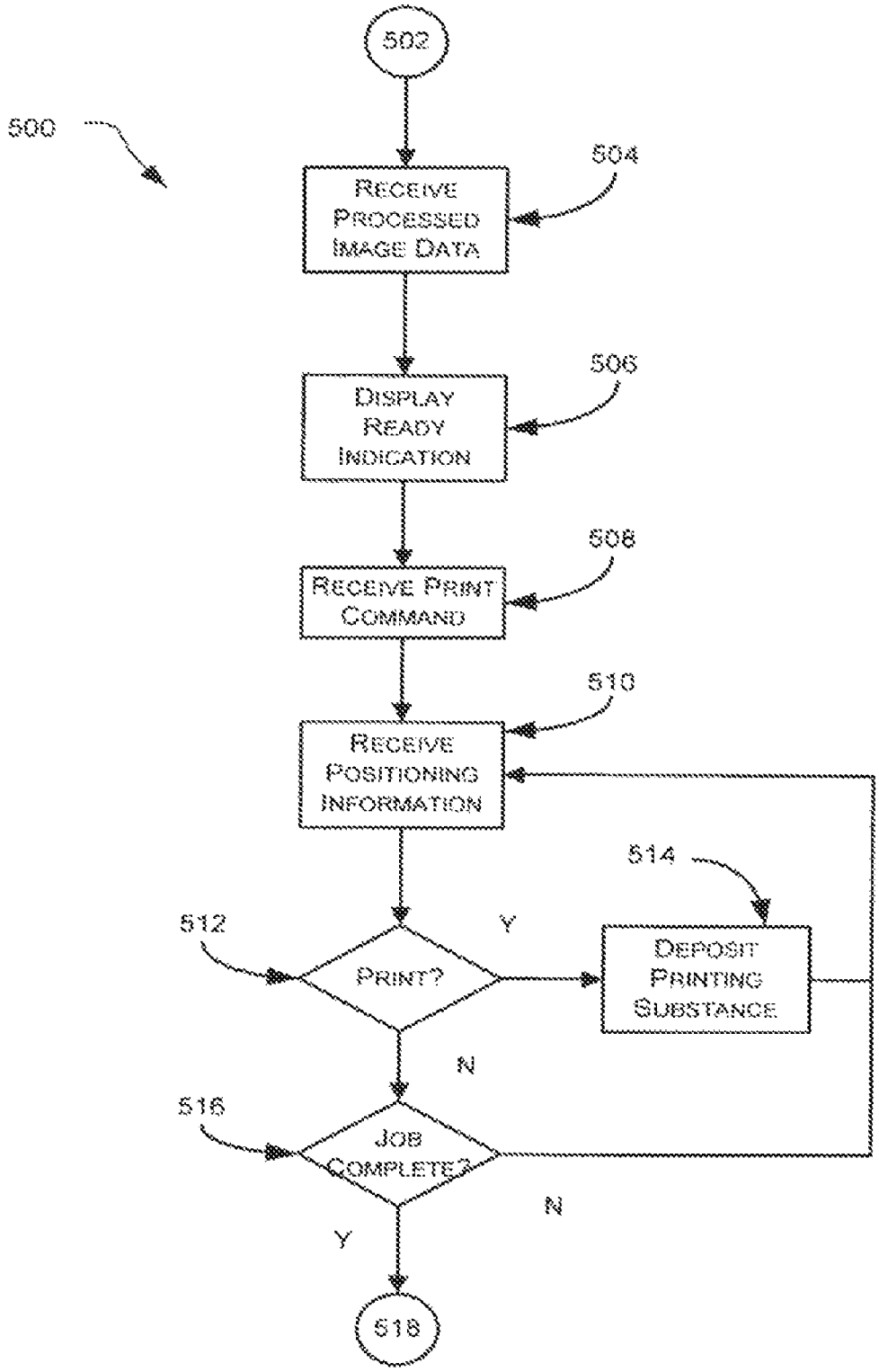
FIG. 5 is a flow diagram describing an exemplary printing operation that may be performed by the hand-held printer.

FIG. 5 depicts a flow diagram illustrating a printing operation 500 that may be performed by the printing device 200. At block 502, the printing operation 500 may begin or be initiated by, for example, a signal provided by the print control input 302.

At block 504, the print module 122 may receive processed image data from the image processing module 118. As previously discussed, the image data may be received in a raw or unprocessed format from the image information source 120 and processed for printing by the image processing module 118. Alternatively, the image data may be preprocessed by the image information source 120 and communicated to the print module 122 as discussed in connection with FIG. 1.

At block 506, the display 306 may indicate that the printing device 200 is ready to print the processed image data. The display 306 may also provide a thumbnail representation of the processed image data. The thumbnail image provided by the display 306 may be utilized to indicate the status of the printing operation 500. For example, thumbnail image may be erased, shaded or otherwise modified as the printing device 200 dispenses and prints the processed image data on a print medium.

At block 508, the print module 122 may receive a signal representative of a print command generated from a user activating the print control input 302 in block 516.

At block 510, the print module 122 may further receive positioning information from the positioning module 126.

At block 512, the print module 122 may then determine whether to deposit printing substance, e.g., one or more colors of ink, at the given location on the surface of the print medium. For example, the determination to print or deposit ink may be a function of the total drop volume to be placed at a given location on the surface of the print medium and the drop volume previously deposited at that location. If additional printing or deposition is to occur, then at block 514 the print module 122 may cause the print head 108 to dispense an appropriate amount of the printing substance as the printing device 200 is moved or propelled across the surface of the print medium by the user. The printing operation 500 may, in turn, return to the block 510 to receive additional positioning information in preparation for further deposition.

If no additional printing or deposition is to occur, then at block 516, the printing operation 500 may determine if the print job has been completed. The determination of whether the print job is complete may be a function of the printed volume versus the total print volume. Alternatively, the determination to end the printing operation 500 may be reached even if the printed volume is less than the total print volume. For example, the end of the printing operation 500 may occur when the printed volume is ninety-five percent (95%) of the total print volume. If the print job is completed, then at block 518 the printing operation 500 ends. If the print job is not complete, then the printing operation 500 may return to the block 510 to receive additional positioning information in preparation for further deposition.

Figure 6A:
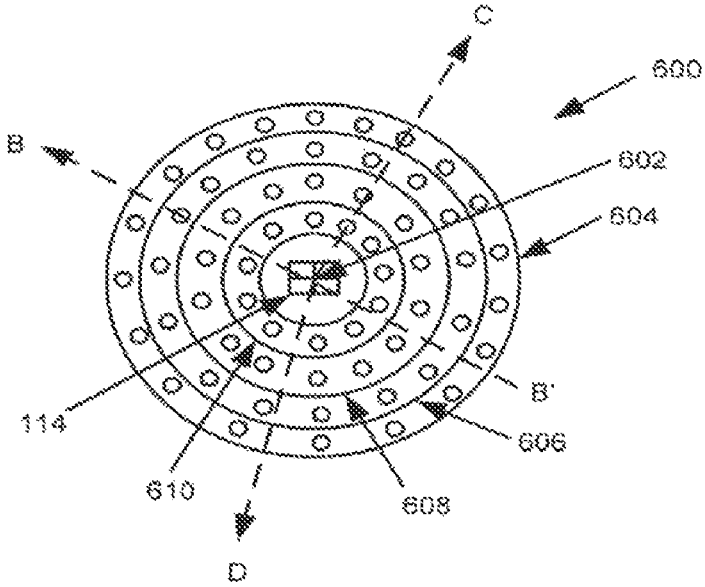
FIGS. 6A and 6B are enlarged views of exemplary nozzle arrays constructed in accordance with the teaching and disclosure provided herein.
Figure 6B:
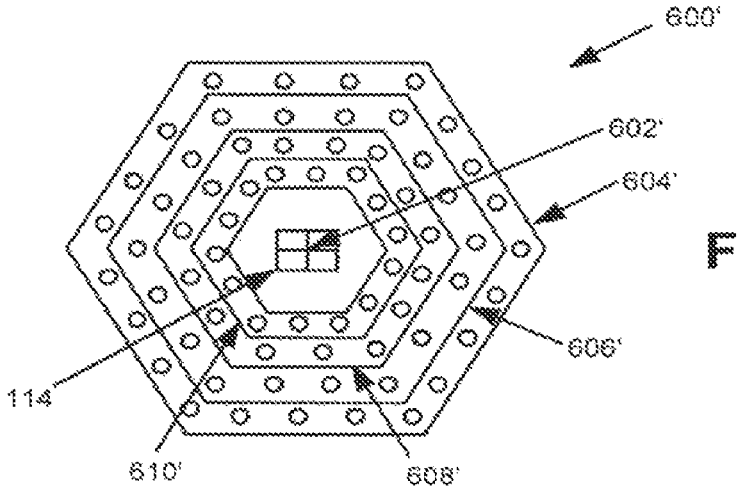

FIGS. 6A and 6B illustrate exemplary physical arrangements of the print head 108 including nozzle arrays configured to optimize hand-held printing. For example, during a typical printing operation, the user may propel or move the printing device 200 in a side to side motion as indicated by the arrow A (see FIG. 2A). The back and forth motion of the printing device 200, in turn, moves and positions the linear nozzle arrays 204 to 210 to desired positions over the surface of the print medium. Printing substances, and in particular CMYK inks, which may be dispensed by the printing device 200, as directed by the print module 122, are often calibrated, tested and otherwise arranged to create or provide colors based on their deposition order and/or amounts. For example, to create a given color could require that four (4) parts cyan, two (2) part yellow and six (6) parts magenta be deposited in a particular order and in the specified amounts. Maintaining or providing the correct deposition order may be difficult given the erratic motion of the printing device 200 and the physical arrangement of the nozzle arrays 204 to 210.

FIG. 6A illustrates one embodiment of an exemplary print head 108 that includes a concentric circular nozzle array 600 optimized for multidirectional printing. In particular, the concentric circular nozzle array 600 may include a nozzle array 604 for cyan-colored ink (C), a nozzle array 606 for magenta-colored ink (M), a nozzle array 608 for yellow-colored ink (Y), and nozzle array 610 for black-colored ink (K). In this exemplary embodiment, the each of the circular nozzle arrays 604 to 610 may be concentric around or equidistant to a reference point 602. Moreover, the reference point 602 may further be the location of the optical image sensors 114.

In this exemplary embodiment, the configuration and relative position of the circular nozzles 604 to 610 allows for multi-color dispensing and printing in variety or multitude of vectors or directions. For example, instead of dispensing and printing when the printing device 200 is propelled by the user in a side-to-side manner (see arrow A in FIG. 2A), the user may move the printing device 200 in any direction or vector along the surface of the print medium and dispense printing substances. The vector arrows B, C and D indicate three (3) distinct directions in which the printing device 200 may be propelled by the user. It will be understood that given the circular arrangement of the concentric circular nozzle array 600 any number of directions or vectors may be utilized. Regardless of the specific vector arrow B, C and D followed by the printing device 200, it will be noted that the relative position and alignment of the circular nozzle arrays 604 to 610 remain fixed and constant with respect to each other and the reference point 602. Moreover, as shown by the extended vector B, the leading edge portion (near the label B) and trailing edge portion (near the label B') of the circular arrangement of the nozzle array 600 effectively provides for two, albeit mirror images of each other, separate arrays which may be utilized to dispense printing substances. The print module 122 may be utilized to control, time and otherwise direct the dispensing of printing substances from, for example, the circular nozzle array 606 disposed substantially adjacent to the leading edge portion (near the label B) and the circular nozzle array 606 disposed substantially adjacent to the trailing edge portion (near the label B') as the printing device 200 is moved along the printing surface.

FIG. 68 illustrates another embodiment of an exemplary print head 108 that includes a polygon nozzle array 600' optimized for multidirectional printing. In particular, the polygon nozzle array 600' may include a nozzle array 604' for cyan-colored ink (C), a nozzle array 606' for magenta-colored ink (M), a nozzle array 608' for yellow-colored ink (Y), and nozzle array 610' for black-colored ink (K). In this exemplary embodiment, the polygon nozzle array 606' may be substantially concentric around or substantially equidistant to a reference point 602'. Moreover, the reference point 602' may further be the location of the optical image sensors 114.

Figure 7:
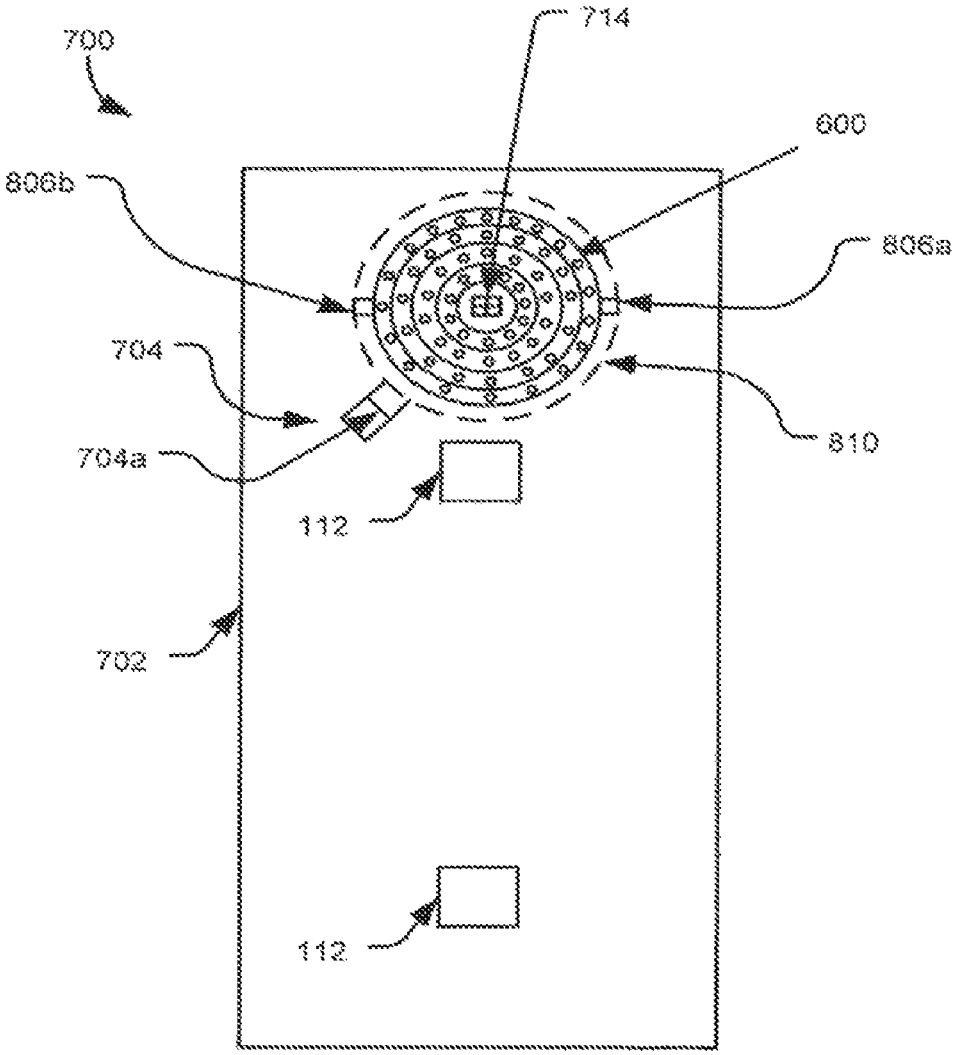
FIG. 7 is a bottom plan view of the hand-held printer including the exemplary nozzle array shown in FIG. 6A.

FIG. 7 illustrates an alternation bottom plan view of a printing device 700 which may be constructed to include the teachings discussed in conjunction with the logical schematic 100 and the mobile or hand propelled printer 102. In particular, the printing device 700 may include the concentric circular nozzle array 600 and an imaging array 714 (see the imaging array 114 in FIG. 6A) mounted in the printer housing 702. In particular, the imaging array 714 may be mounted or positioned within the center or central portion of the circular nozzle array 600. The imaging array 714 may be, for example, a line scanner, optical sensors such as a charge coupled device (CCD) or any other imaging or scanning device.

The housing 702 further includes a locking mechanism 704 disposed substantially adjacent to the concentric circular nozzle array 600. The locking mechanism 704 may be a spring loaded latch configured to releasably cooperate with a protective cap or cap 800 (see FIGS. 8A to 8C). Alternatively, the locking mechanism 704 may be a friction lock that utilizes a slip or interference fit with the housing 702 to engage and secure the cap 800.

Figure 8A:
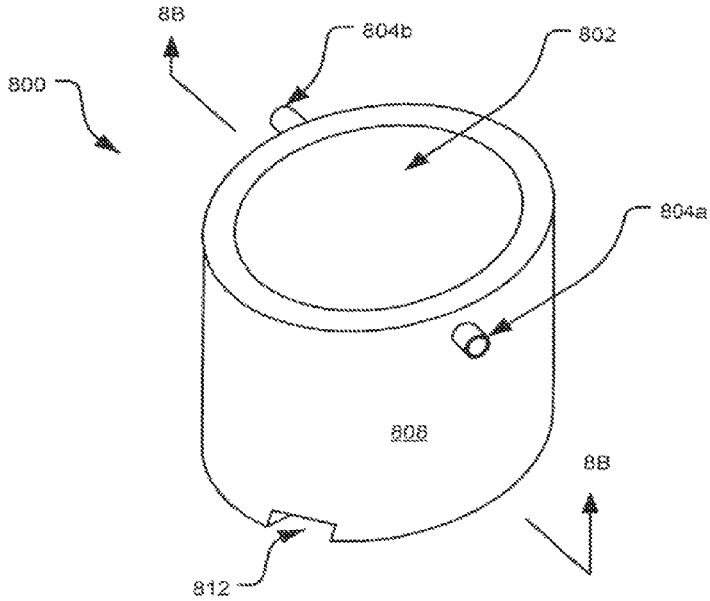
FIGS. 8A, 8B and 8C illustrate an exemplary cap configured to cooperate with the hand-held printer shown in FIG. 7.
Figure 8B:
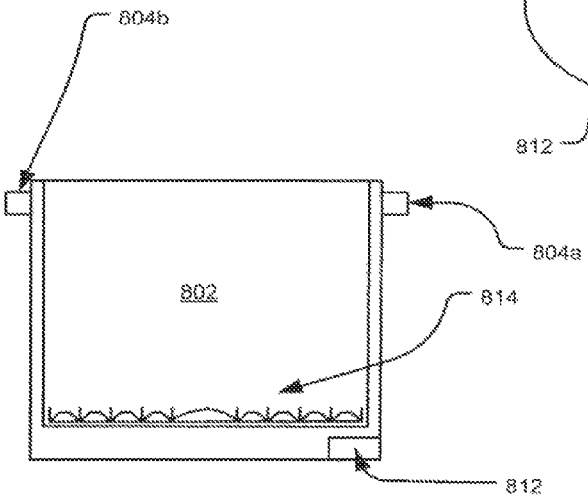
Figure 8C:
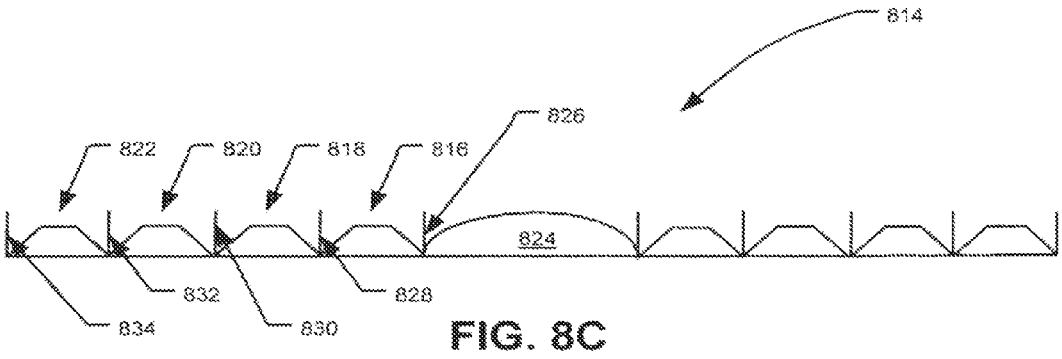

FIGS. 8A, 8B and 8C illustrate various exemplary view of the cap 800 and components carried therein. FIG. 8A illustrates an enlarged, inverted view of the cap 800 sized to cooperate with the concentric circular nozzle array 600 and the housing 702. The exemplary cap 800 is a substantially cylindrical structure defining a hollow interior 802 sized to enclose and cooperate with the concentric circular nozzle array 600. The cap 800 further includes a pair of guide posts 804*a*, 804*b* formed or carried along an outer surface 808 of the cap 800. The guide posts 804*a*, 804*b* are sized and arranged to cooperate with a pair of guides 806*a*, 806*b* (see FIG. 7) formed within the housing 702. Alternatively, the guide posts 804*a*, 804*b* may be threads configured to cooperate with the guides 806*a*, 806*b*.

In operation, the guide posts 804*a*, 804*b* are aligned with the guides 806*a*, 806*b* in preparation for closing and sealing the concentric circular nozzle array 600. The guide posts 804*a*, 804*b*, once aligned via the guides 806*a*, 806*b*, engage a substantially circular track, guide or path 810 that directs the rotational movement of the cap 800 as it turns from an open position to a closed position adjacent to the concentric circular nozzle array 600 and the locking mechanism 704. The path 810 may, for example, define a downward, i.e., into the housing 702, corkscrew path that guides the cap 800 into contact with the concentric circular nozzle array 600. Alternatively, the path 810 may be a cam or other guide mechanism configured to close and provide a specific movement or action during the closure of the cap 800. The path 810 may include a detent over which the cap 800 must be forced to fully engage with the concentric circular nozzle array 600 and the housing 702. In operation, as the cap 800 rotates towards the closed position, the wipers 816 to 822 engage and wipe the nozzle array. As the cap 800 and guide posts 804*a*, 804*b* engage the detent, the seals 826 to 834 compress tightly then relax, causing a back-pressure to be created.

The lock mechanism 704 may engage and cooperate with a slot 812 to secure the cap 800 in the closed position. For example, if the lock mechanism 704 is a spring loaded mechanism, then a tab 704*a* may be displaced by the outer surface 808 of the cap 800 as it comes into contact with the guides 806*a*, 806*b* and the path 810. When the cap 800 is aligned in the closed position, the slot 812 may be aligned with the tab 704*a*. The mutual alignment of the two components, allows tab 704*a* to engage the slot 812 and thereby secure the cap 800 in the closed position. The spring may store enough energy when compressed that upon release of the lock mechanism 704, the spring may cause the cap 800 to disengage, e.g., move past the detent, to allow for east removal.

FIG. 8B illustrates a cross-sectional view of the cap 800 taken along the section line 8B-8B. The cap 800 may support and carry a substantially circular cleaning pad 814 within the hollow interior 802. The cleaning pad 814 may, in turn, include wipers 816 to 822 (see FIG. 8C for an enlarged view of the cleaning pad 814). The wipers 816 to 822 may represent a single strip of wipers formed from a deformable material such as rubber, cloth, silicon, or any other compressible, air-tight material that is resistant to the corrosiveness of the ink. Different ink formulations may require different materials and/or material formulations. In this configuration, the cap 800 would require at least one three-hundred and sixty degree (360°) rotation in order to engage the single strip of wipers 816 to 822 with each of the individual nozzles comprising the circular nozzle arrays 604 to 610. Alternatively, the wipers 816 to 822 may represent multiple wipers array around the cleaning pad 814. In this alternate configuration, the cap 800 may be rotated, for example, ninety degrees (90°) while allowing the multiple wipers 816 to 822 to engage each of the individual nozzles comprising the circular nozzle arrays 604 to 610. The minimum rotation that may be experienced by the cap 800 and wipers 816 to 822 could be defined by the arc-length between two nozzles within any one of the circular nozzle arrays 604 to 610. This minimum rotation ensures that each nozzle within the circular nozzle arrays 604 to 610 comes into contact with at least one of the wipers 816 to 822 in the alternate configuration.

The cleaning pad 814 may further include a sensor pad 824 arranged and configured to rotatably engage and clean the imaging array 714 as the cap 800 rotates towards the closed position. The sensor pad 824 may be a micro-fiber pad provided by and configured to remove material, debris, etc. from the surface of the imaging array 714.

The cleaning pad 814 may further include a plurality of deformable or flexible sealing gaskets 826 to 834 disposed adjacent to the multiple wipers 816 to 822. The sealing gaskets 826 to 834 may be configured to engage, and deform against, the surface of the circular nozzle arrays 604 to 610. In particular, the sealing gaskets 826 to 834 may be aligned between the individual nozzles comprising the circular nozzle arrays 604 to 610. When the cap 800 is secured at the closed position, the sealing gaskets 826 to 834 may enclose and prevent the circular nozzle arrays 604 to 610 from exposure and drying causes by air. Moreover, as the cap 800 is rotated towards the closed position, the sealing gaskets 826 to 834 may be deformed and compressed and then release slightly, while maintaining their seal, in order to create a partial or slight vacuum around the circular nozzle arrays 604 to 610.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A cleaning mechanism for a hand-held printer, the cleaning mechanism comprising:

a circular cap configured to rotatably cooperate with a print head to define a seal when the circular cap is in a closed position, wherein the print head comprises a plurality of nozzle arrays disposed substantially equidistant from a scanning device; and a sensor pad disposed adjacent to the scanning device when the circular cap is in the closed position.

2. The cleaning mechanism of claim 1, further comprising:

a cleaning pad configured to rotatably engage the plurality of nozzle arrays.

3. The cleaning mechanism of claim 2, wherein the cleaning pad includes a plurality of wipers.

4. The cleaning mechanism of claim 3, further comprising:

a plurality of sealing gaskets, wherein each of the plurality of sealing gaskets is disposed adjacent to at least one of the plurality of wipers.

5. The cleaning mechanism of claim 1, further comprising:

a locking mechanism configured to secure the circular cap in the closed position.

6. The cleaning mechanism of claim 5, wherein the locking mechanism and the circular cap are configured to cooperate with at least one sealing gasket to establish a low pressure region adjacent to at least one of the plurality of nozzle arrays.

7. The cleaning mechanism of claim 1, further comprising:

at least one guide post supported by the circular cap, wherein the at least one guide post is configured to cooperate with the print head to guide the circular cap into contact with the plurality of nozzle arrays.

8. The cleaning mechanism of claim 7, wherein the at least one guide post is guided along a path including a spring loaded latch that when released is configured to disengage the circular cap past a detent.

9. The cleaning mechanism of claim 7, wherein the at least one guide post is guided along a path defined by an arc-length between any two nozzles in one of the plurality of nozzle arrays.

10. A method of maintaining a print head of a hand-held printer with a cleaning mechanism, the method comprising:

aligning a circular cap to a plurality of nozzle arrays of the print head of the hand-held printer, wherein the plurality of nozzle arrays are disposed substantially equidistant from a scanning device;

rotating the circular cap to a closed position, wherein the circular cap is configured to rotatably cooperate with the print head to define a seal when the circular cap is in the closed position;

engaging the plurality of nozzle arrays with a cleaning pad carried by the circular cap in the closed position of the circular cap;

and moving a sensor pad to a position adjacent to the scanning device when the circular cap is in the closed position.

11. The method of claim 10, further comprising:

creating a vacuum between the cleaning pad and the plurality of nozzle arrays.

12. The method of claim 10, further comprising:

engaging the plurality of nozzle arrays, in the closed position of the circular cap, with a plurality of wipers included on the cleaning pad in the closed position of the circular cap.

13. The method of claim 12, further comprising:

engaging the plurality of nozzle arrays with a plurality of sealing gaskets, wherein each of the plurality of sealing gaskets is disposed adjacent to at least one of the plurality of wipers.

14. The method of claim 12, further comprising:

securing the circular cap in the closed position with a locking mechanism.

15. The method of claim 10, further comprising:

establishing a low pressure region between at least one sealing gasket and at least one of the plurality of nozzle arrays by compression and then slight release of the at least one sealing gasket.

16. The method of claim 10, further comprising:

rotating at least one guide post supported by the circular cap in a guide path adjacent to the print head.

17. The method of claim 16, further comprising:

disengaging the circular cap from a locked position using a spring loaded latch in the guide path.

18. The method of claim 16, wherein the guide path is defined by an arc-length between any two nozzles in one of the plurality of nozzle arrays.

19. A method of maintaining a print head of a hand-held printer, the method comprising:

aligning a cleaning cap to a nozzle array portion of the print head of the hand-held printer;

rotating the cleaning cap to engage the nozzle array portion with a cleaning pad carried by the cleaning cap in order to seal the nozzle array portion with the cleaning cap;

creating a vacuum between the cleaning pad and the nozzle array portion as the cleaning cap is rotated to the closed position;

wherein the cleaning pad is disposed adjacent to a scanning device when the cleaning cap is in the closed position.

20. The method of claim 19, wherein rotating the cleaning cap further comprises:

wiping individual nozzles of the nozzle array portion with at least one wiper disposed on the cleaning pad, and wherein sealing the nozzle array portion further comprises:

creating individual seals between each of individual nozzles which comprise the nozzle array portion; and engaging at least one flexible seal gasket adjacent to each of the individual nozzles of the nozzle array portion to create the individual seals.

* * * * *